US006953137B2

(12) United States Patent
Nakano et al.

(10) Patent No.: US 6,953,137 B2
(45) Date of Patent: Oct. 11, 2005

(54) FASTENER DRIVING TOOL HAVING CONTACT ARM IN CONTACT WITH WORKPIECE

(75) Inventors: Yoshihiro Nakano, Hitachinaka (JP); Isamu Tanji, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/869,935

(22) Filed: Jun. 18, 2004

(65) Prior Publication Data

US 2005/0001001 A1 Jan. 6, 2005

(30) Foreign Application Priority Data

Jun. 20, 2003 (JP) ..... P2003-176595

(51) Int. Cl.[7] ..... B27F 7/17
(52) U.S. Cl. ..... 227/8; 227/130
(58) Field of Search ..... 227/8, 9, 10, 142, 227/147, 130

(56) References Cited

U.S. PATENT DOCUMENTS

| | | | | |
|---|---|---|---|---|
| 4,629,106 A | * | 12/1986 | Howard et al. | 227/8 |
| 5,083,694 A | * | 1/1992 | Lemos | 227/8 |
| 5,597,106 A | * | 1/1997 | Hamano et al. | 227/8 |
| 5,649,660 A | | 7/1997 | Akiba et al. | |
| 5,669,541 A | * | 9/1997 | Ronconi | 227/8 |
| 5,775,201 A | * | 7/1998 | Tanji et al. | 92/85 R |
| 6,394,332 B2 | | 5/2002 | Akiba | |
| 6,641,018 B2 | | 11/2003 | Akiba | |

FOREIGN PATENT DOCUMENTS

| | | |
|---|---|---|
| JP | 2002-283253 | 3/2002 |
| TW | 302804 | 4/1997 |

* cited by examiner

*Primary Examiner*—Scott A. Smith
*Assistant Examiner*—Brian Nash
(74) *Attorney, Agent, or Firm*—Antonelli, Terry, Stout and Kraus, LLP.

(57) ABSTRACT

A nail gun having a contact arm normally biased in a direction away from a workpiece by compression springs. A free end of the contact arm is brought into abutment with a workpiece and a trigger is pulled for driving a nail thereinto. In the trigger pulling operation, an inner end of the contact arm is engaged with a trigger arm which is biased by a plunger spring through a plunger. Because the contact arm is held on the workpiece, the plunger is moved to provide ON state against biasing force of the plunger spring. Immediately after the nail driving, a nail gun body is moved in a direction away from the workpiece relative to the contact arm. This causes disengagement of the trigger arm from the inner end, to relatively move the nail gun body toward the workpiece by the biasing force of the compression springs. This means relative movement of the contact arm in the direction away from the workpiece. If the trigger is released, the trigger arm is again brought into engagement with the inner end, because the trigger arm is normally urged toward the inner end by a trigger arm spring.

7 Claims, 9 Drawing Sheets

FASTENER DRIVING TOOL HAVING CONTACT ARM IN CONTACT WITH WORKPIECE

BACKGROUND OF THE INVENTION

The present invention relates to a fastener driving tool such as a nail gun, and more particularly, to the nail gun electrically or pneumatically operated for providing a fine appearance on a workpiece after nail fastening.

Attachment members or finishing materials for use in a baseboard for trimming purposes or for a verandah running on more than two sides of a house or room are adhesively fixed to a wall, and then fixed by fasteners such as nails. A groove having a predetermined small width is formed in the attachment member, and the nails are driven into the groove. The nails have a head portion whose color is selected to be in conformance with the external color of the attachment member. Further, the head portion of the nail has a small diameter, so that the head portion can be positioned onto a bottom of the small width groove in an attempt to obtain good external appearance on the attachment member without any scratches as bruises after the nail driving.

A conventional pneumatically operated nail gun includes a main housing, a magazine, a drive bit, a bit guide and a contact arm. A plurality of nails are arrayed side by side in the magazine and a frontmost nail is introduced into the bit guide and is driven into a workpiece such as an attachment member by the drive bit. The contact arm has a free end portion adapted to be in pressure contact with the workpiece. The contact arm has another end portion adapted to push a trigger plate. A valve plunger can be pushed up upon manipulation of a trigger as far as the trigger plate is in the pushed up position. The contact arm is normally biased by a spring toward the attachment member, i.e., in a pushed out direction from the main housing. That is, the contact arm is movable relative to the main housing. When the contact arm is pushed or retracted into the main housing against the biasing force of the spring and the trigger are operated, a nail driving operation can only be started. Therefore, accidental nail shooting other than intended nail driving operation can be prevented.

According to such a conventional nail gun, the nail gun must be moved away from the attachment member so as to separate the free end of the contact arm from the attachment member after the nail driving operation, if the nail gun is to be moved to a next nail shooting position. Because the contact arm is urged toward the pushed out stroke end position by the biasing force of the spring, the nail gun must further be moved by a moving stroke of the contact arm in case of the movement of the nail gun to the next nail shooting position. Here, the moving stroke implies a distance between the most pushed out position (hereinafter simply referred to as a bottom dead center) and the most retracted position (hereinafter simply referred to as an top dead center) of the contact arm with respect to the main housing.

Laid open Japanese Paten Application Publication No. 2002-283253 discloses a nail gun provided with an urging member that normally urges a contact arm toward the top dead center. This can reduce pushing force of the free end of the contact arm against the attachment member for the nail driving operation. Thus, finishing appearance of the attachment member and operability to the nail gun can be improved.

In the nail gun disclosed in the JP publication, immediately after the nail driving operation upon pulling a trigger, a free end of a contact arm is maintained at its bottom dead center position. The contact arm is maintained at a pushed down position by a trigger arm because a plunger of a trigger valve maintains the posture of the trigger arm by way of a spring associated with the plunger as long as a pulling state of the trigger is maintained after the nail driving operation, even if the nail gun is moved to separate from the attachment member. The contact arm restores its top dead center position only when the trigger is released.

A great number of nails must be driven into the attachment member in the nail driving work within a limited period of time. Therefore, an operator must promptly shift the nail gun to a next nail shooting position immediately after the nail driving operation. Normally, the operator maintains pulling state of the trigger during shifting of the nail gun to the next shooting position, and then releases the trigger after the nail gun is placed on the next shooting position. Alternatively, the operator maintains pulling state of the trigger and then releases the trigger during shifting of the nail gun to the next shooting position. In other words, the contact arm maintained at its bottom dead center position during shifting of the nail gun to the next shooting position as long as pulling state of the trigger is maintained. Consequently, the free end of the contact arm may be tangled or abutted against walls of the grooves of the attachment member to damage to the contact arm and the attachment member. If the trigger is released after the nail gun is placed on the next shooting position, the contact arm promptly restores its top dead center position upon release of the trigger. Accordingly, the nail gun must be further moved toward the attachment member by the moving stroke of the contact arm, whereupon moving impact force is generated so that the free end of the contact arm may damage to the attachment member.

SUMMARY OF THE INVENTION

It is therefore an object of the present invention to overcome the above-described problems and to provide an improved nail gun providing sufficient operability and workability and capable of lowering accidental injury on the attachment member by a free end of the contact arm during shifting of the nail gun to a next shooting position in sequential nail driving operation.

This and other objects of the present invention will be attained by a fastener driving tool for driving a fastener into a workpiece generally including a main driving section, a trigger mechanism, a contact arm, a contact arm spring, and a switch mechanism. The main driving section includes a main housing, and a drive bit movable in a first direction toward the workpiece and in parallel with an extending direction of the drive bit and movable in a second direction opposite to the first direction. The trigger mechanism is pivotally movable in an operating direction and a non-operating direction and is supported to the main housing. The contact arm is movable toward its top dead center position in the second direction and toward its bottom dead center position in the first direction. The contact arm has a free end portion and a trigger associating portion associatable with the trigger mechanism. The contact arm spring is adapted for biasing the contact arm in the second direction. The switch mechanism includes a plunger and a plunger spring. The plunger is movable between OFF position where driving movement of the drive bit is prohibited and ON position where driving movement of the drive bit is permitted. The plunger is abuttable on the trigger mechanism and is movable to the ON position by the movement of the trigger mechanism in the operating direction. The plunger spring biases the plunger toward the OFF position. The plunger spring provides a biasing force greater than that of the contact arm spring. The trigger associating portion is lockingly engaged with the trigger mechanism at least when the contact arm is positioned at its top dead center and when the trigger mechanism is moved to its operating direction. The trigger associating portion is disengaged from the trigger mechanism when the contact arm becomes movable toward the first direction for permitting the contact arm to be moved toward the top dead center by the biasing force of the contact arm spring.

DETAILED DESCRIPTION OF THE PREFERRED EMBODIMENTS

Figure 1:
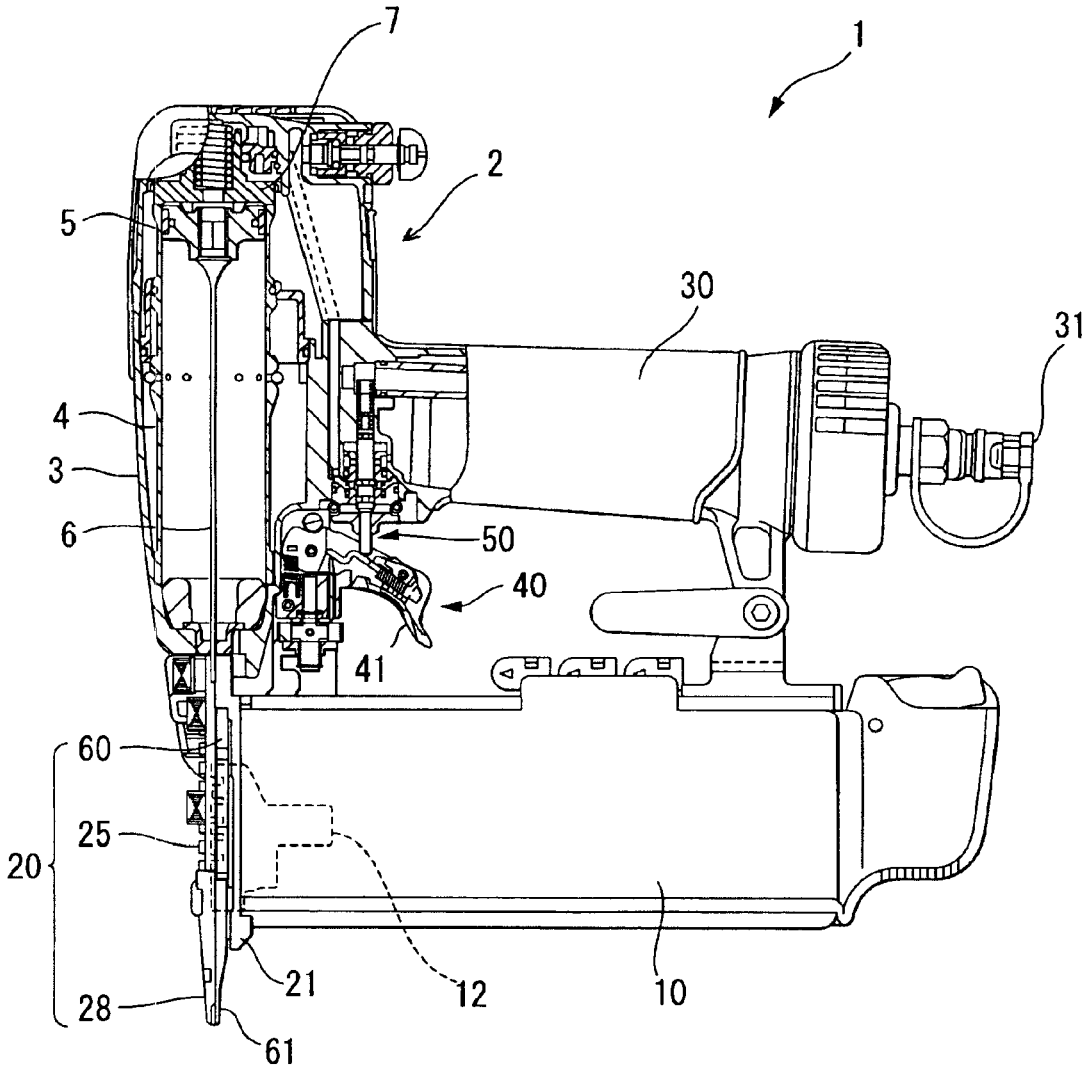
FIG. 1 is a partly cross-sectional side view showing a nail gun according to one embodiment of the present invention.

A nail gun according to one embodiment of the present invention will be described with reference to FIGS. 1 through 10. As shown in FIG. 1, the nail gun 1 generally includes a main driving section 2 including a main housing 3, a magazine 10, a nail injection section 20, a handle 30, a trigger mechanism 40, a switch mechanism or a trigger valve mechanism 50 and a contact arm 60. The handle 30 extends from the main housing 3 in a direction substantially perpendicular thereto. The injection section 20 extends from a lower side of the main housing 3 in a longitudinal direction of the main housing 3. The magazine 10 extends substantially in parallel with the handle 30 and is supported between the handle 30 and the injection section 20. The trigger mechanism 40 is provided nearby a base end portion of the handle 30. The trigger mechanism 40 has a trigger 41 supported to the main housing 3 at a position surrounded by the main housing 3, the magazine 10 and the handle 30. The trigger valve mechanism or a switch mechanism 50 is positioned adjacent to the trigger mechanism 40. The contact arm 60 has an outer tip end portion constituting a part of the injection section 20, and an inner end portion associated with the trigger mechanism 40. The contact arm 60 is movable with respect to the main housing 3.

The handle 30 has a connector 31 fluidly connected to a compressor (not shown) through a hose (not shown). A compressed air chamber is defined in the internal space of the handle 30 for accumulating therein a compressed air supplied from the compressor.

Inside the main housing 3, a cylinder 4, a piston 5, a major length part of a drive bit 6, and a head valve 7 are provided. The piston 5 is reciprocally movable within the cylinder 4 in an axial direction thereof. The head valve 7 is disposed above the cylinder 4 and is fluidly connected to the trigger valve mechanism 50 for selectively introducing compressed air in the compressed air chamber into an upper region of the piston 5 upon placement of the outer tip end portion of the contact arm 60 onto the attachment member and upon pulling operation of the trigger 41 by an operator's finger which also grips the handle 30. The drive bit 6 extends from the piston 5 toward the injection section 20. A tip end of the drive bit 6 is abuttable on a nail 11A (FIG. 10) set at the injection section 20 when the piston 5 is moved toward the injection section 20. The contact arm 60 is movable in an extending direction of the drive bit 6.

The magazine 10 is provided for accommodating therein congregated nails or a nail bundle 11 (FIG. 10) in which nails are arrayed side by side and bonded together with an adhesive. A nail feeder 12 is provided in the magazine 10 for feeding and positioning respective one of the nails 11 to a given position at the injection section 20. A spring (not shown) is provided in the magazine 10 for biasing the nail feeder 12 toward the injection section 20.

Figure 2:
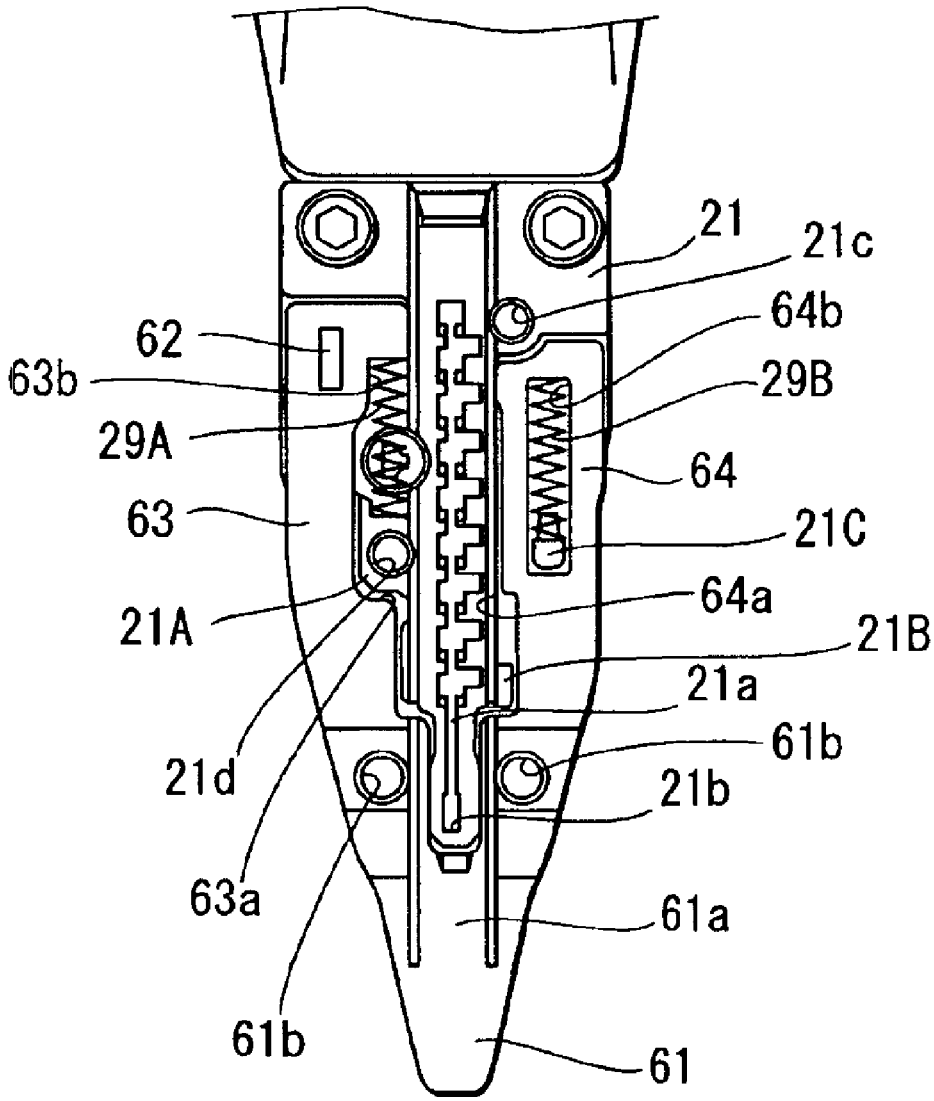
FIG. 2 is an enlarged front view showing a free end portion in an injection section of the nail gun according to the present invention, and in which a guide plate and a nose are removed from a contact arm.

As shown in FIGS. 1 and 2, the injection section 20 includes a bit guide 21, a tip end region of the contact arm 60, a guide plate 25, a nose 28, and compression springs 29A, 29B. The bit guide 21 has a generally plate shape and is fixed to the lower side of the main housing 3 and extends in the longitudinal direction thereof. The nail feeder 12 is urged by the spring (not shown) toward the bit guide 21. As shown in FIG. 2, a nail passage 21*a* is formed at a substantially center position of the bit guide 21 for allowing the nail 11A (FIG. 5) fed by the nail feeder 12 to pass therethrough.

The nail passage 21*a* has a plurality of recessed parts arrayed in the longitudinal direction thereof. Heads of nails having length different from each other can be temporarily retained in one of the recess, and the head can be passed through the recessed parts. This structure is conventional, and therefore, further description is negligible. A nail tip retaining groove 21*b* in alignment with and downstream of the nail passage 21*a* is formed in the bit guide 21 for temporarily supporting a tip end of each nail. Further, guide projections 21A, 21B protrude from the surface of the bit guide 21 in a thickness direction thereof, and extend in a direction in parallel with the nail passage 21*a*. Additional projection 21C protrudes from the surface of the bit guide 21 for serving as a spring seat. Female threads 21*c* is formed at the bit guide 21, and another female thread 21*d* is formed at the guide protrusion 21A of the bit guide 21.

A tip end region of the contact arm 60 is slidably and reciprocally movably supported by the bit guide 21. More specifically, as shown in FIG. 2, the contact arm 60 has a tip end portion 61, a slide-guide portion 62, and a trigger associated portion 69 (FIG. 3) positioned in the vicinity of the trigger 41. The tip end portion 61 has a flat plate like configuration and is tapered to gradually reduce its width toward its distal end. An injection passage 61*a* downstream of the nail tip retaining groove 21*b* is partly defined by the tip end portion 61. Further, female threads 61*b*, 61*b* are formed beside the injection passage 61*a*.

The slide-guide portion 62 includes a pair of guide sections 63, 64 branched from the tip end portion 61 and extending in the longitudinal direction of the nail passage 21*a*. The pair of guide sections 63, 64 are positioned substantially symmetrically with respect to the nail passage 21*a*. The guide sections 63, 64 have opposing sides defining guide groove walls 63*a*, 64*a*, and the guide protrusions 21A and 21B are disposed in sliding contact with the guide groove walls 63*a*, 64*a*, respectively. Therefore, the contact arm 60 is slidably supported with respect to the bit guide 21 by the guiding relationship between the guide groove walls 63*a*, 64*a* and the guide protrusions 21A and 21B.

The guide sections 63, 64 are formed with spring retaining portions 63*b*, 64*b* in which the compression springs 29A, 29B are retained respectively. The compression spring 29A has one end seated on the spring retaining portion 63*b* and another end seated on the guide protrusion 21A positioned within the spring retaining portion 63*b*. Further, the compression spring 29B has one end seated on the spring retaining portion 64*b* and another end seated on the guide protrusion 21C positioned within the spring retaining portion 64*b*. Therefore, the contact arm 60 is urged toward its top dead center position. Further, the spring retaining portions 63*b*, 64*b* are positioned substantially symmetrically with respect to the nail passage 21*a*, and biasing force of the compression springs 29A, 29B are substantially equal to each other in order to avoid inclination of the contact arm 60 and to provide smooth motion of the contact arm 60 during sliding movement thereof along the guide bit 21. Further, a combined biasing force of the compression springs 29A, 29B is set smaller than that of a plunger spring 52 (FIG. 3; described later).

Figure 3:
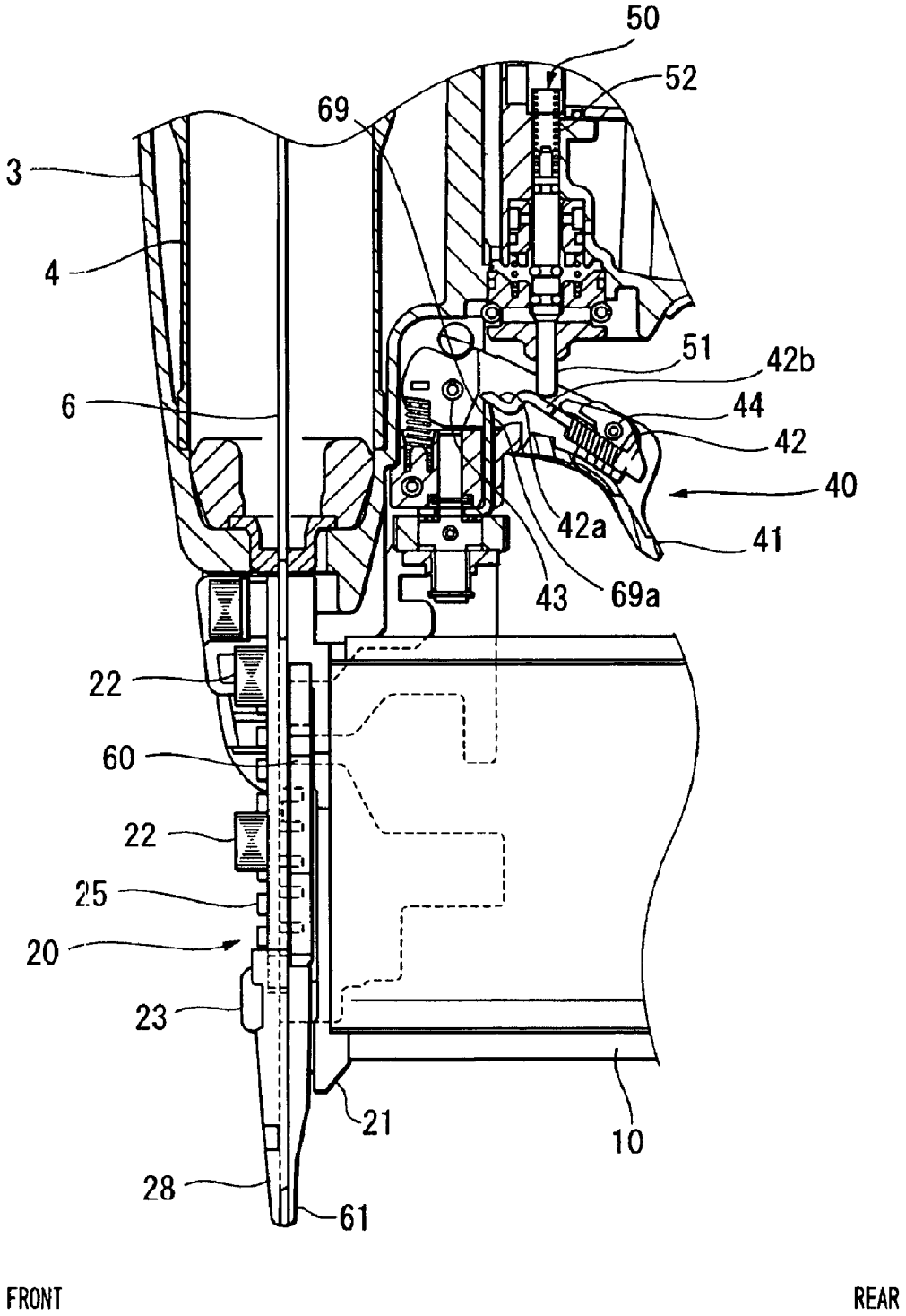
FIG. 3 is an enlarged cross-sectional side view showing an essential portion of the nail gun of FIG. 1.
Figure 4:
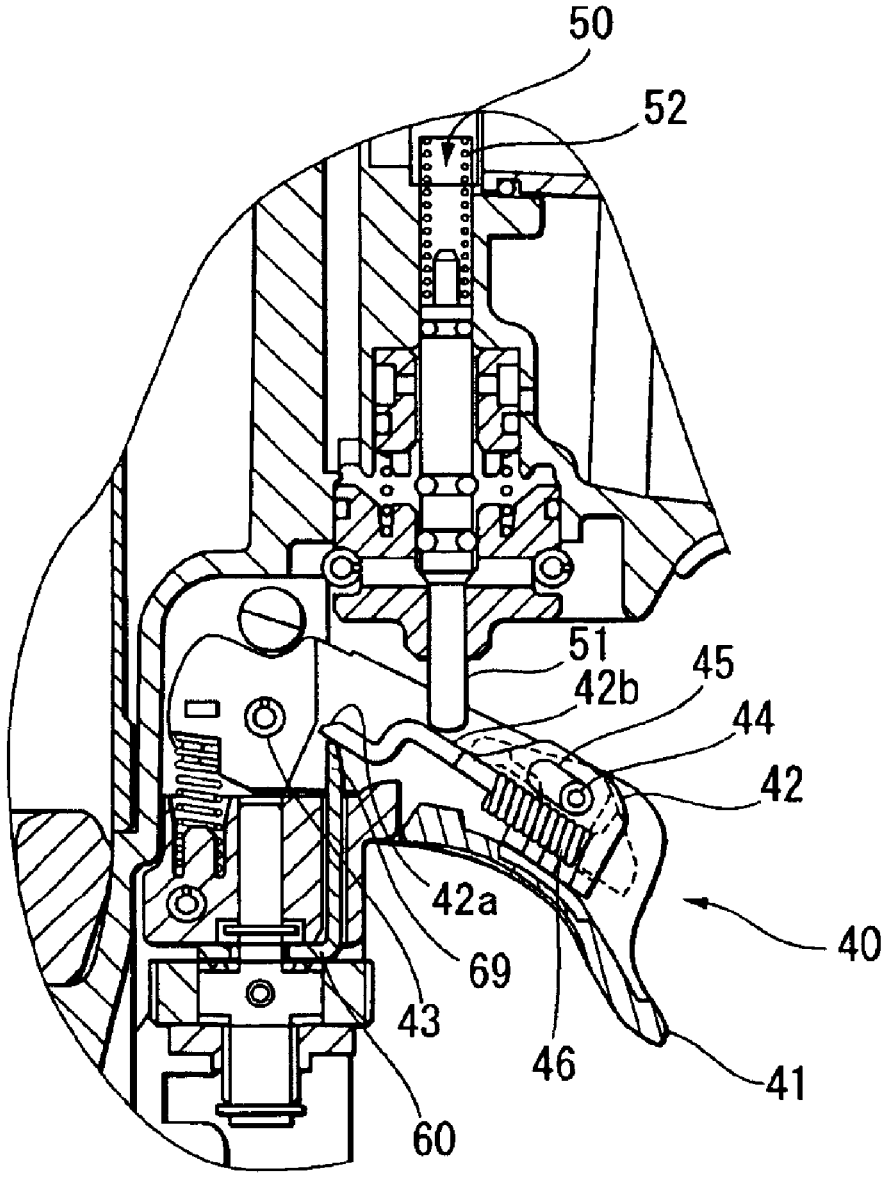
FIG. 4 is an enlarged cross-sectional view showing a trigger mechanism and a switch mechanism shown in FIG. 3 in the nail gun according to the embodiment and in which the contact arm is engaged with a trigger arm.

As shown in FIG. 3, the nail passage 21*a* of the bit guide 21, and the guide sections 63, 64 and the guide groove 63*a*, 63*b* of the contact arm 60 are covered by the guide plate 25. The guide plate 25 is fixed to the bit guide 21 by screws 22 threadingly engaged with the female threads 21*c*, 21*d*. Therefore, the tip end portion 61 of the contact arm 60 is interposed between the bit guide 21 and the guide plate 25. Thus, the contact arm 60 and the nose 28 are moved together. The guide plate 25 also receives urging force of the nail feeder 12 biased toward the nail passage 21*a* by the spring (not shown) in the magazine 10. In other words, the urging force of the nail feeder 12 is not applied to the contact arm 60. Therefore, biasing force of the compression springs 29A, 29B can be set small regardless of the urging force of the nail feeder 12.

Figure 5:
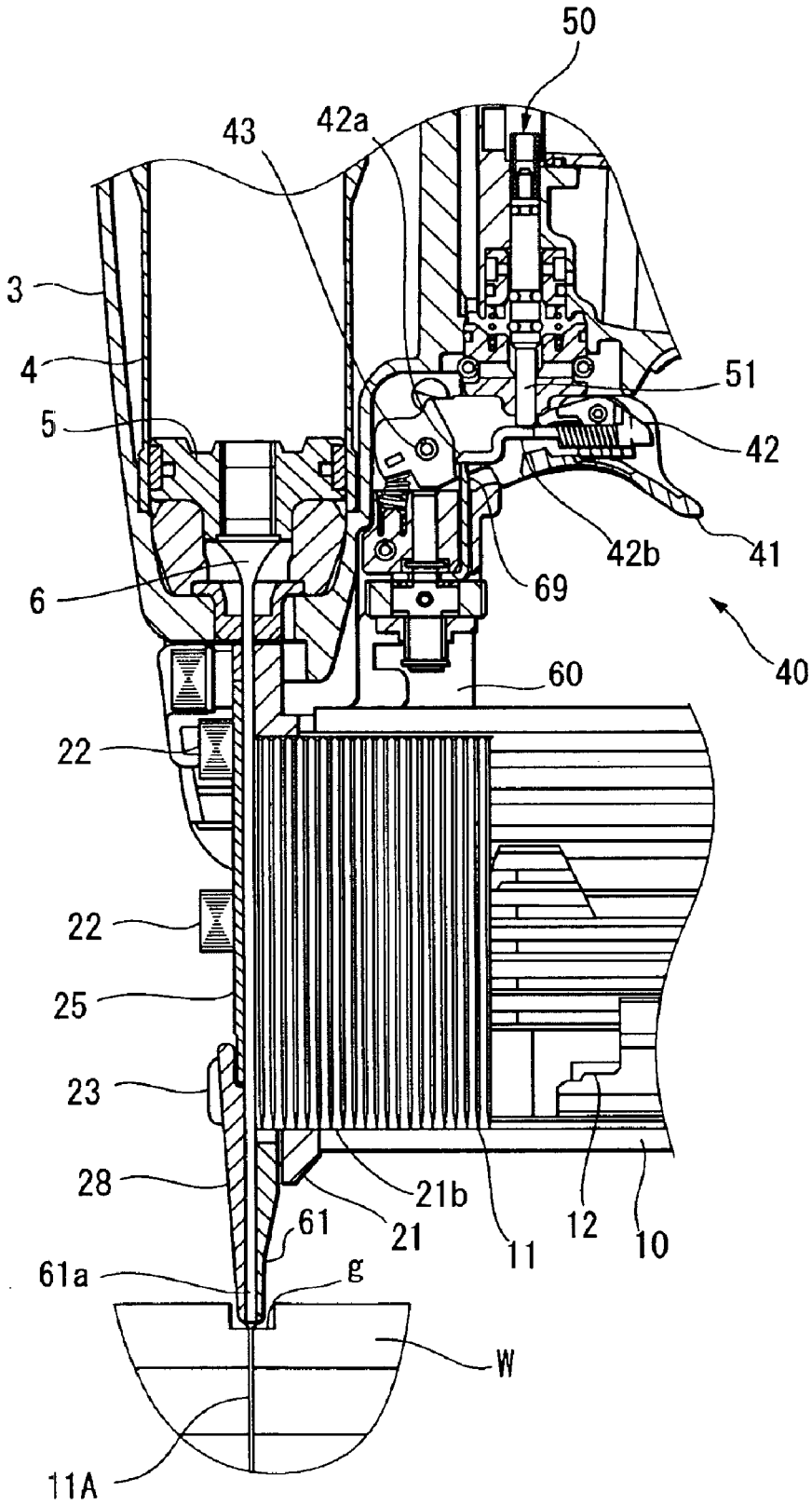
FIG. 5 is a cross-sectional side view showing the nail driving state of the nail gun according to the embodiment.

The nose 28 is fixed to the free end section 61 of the contact arm 60 by screws 23 threadingly engaged with the female threads 61*b*, 61*b*, so that the nose 28 is movable together with the movement of the contact arm 60. The nose 28 is formed with a guide groove (not shown) along its length for guiding movement of the drive bit 6, and defines an injection passage in cooperation with the injection passage 61*a* of the contact arm 60. The nose 28 has a plate like tapered configuration in conformance with the shape of the free end section 61 of the contact arm 60. That is, a width of the nose 28 is gradually reduced toward its distal end. Further, as shown in FIG. 5, a combined thickness of the contact arm 60 and the nose 28 at the distal end thereof is approximately 3.5 mm, which can be inserted into a small width groove "g" of the attachment member W.

Next, the trigger mechanism 40 will be described. A pivot shaft 43 extends from the main housing 3 for pivotally supporting one end portion of the trigger 41, so that the trigger 41 is pivotally movable about the pivot shaft 43. Further, an arm pivot shaft 44 is provided to the trigger 41. More specifically, the trigger 41 has a U-shape cross-section having confronting walls, and the pivot shaft 44 extends between the confronting walls. The trigger arm 42 has one end portion formed with a slot 45 into which the arm pivot shaft 44 extends. Thus, the trigger arm 42 is pivotally movable about the arm pivot shaft 44 and is slidably movable in the frontward rearward direction within the length of the slot 45 with respect to the trigger 41. A compression spring 46 is interposed between the trigger 41 and the trigger arm 42 for normally urging the trigger arm 42 frontward, i.e., toward the pivot shaft 43.

The trigger arm 42 is movable between a frontmost position and a rearmost position with respect to the trigger 41. In the frontmost position, a front end 42*a* of the trigger arm 42 is engagable with a distal end of the trigger associated portion 69 of the contact arm 60, and an intermediate portion 42*b* of the trigger arm 42 is in engagement with the plunger 51. The front end 42*a* is disengaged from the trigger associated portion 69 when the trigger arm 42 is on its way to the rearmost position. Incidentally, a reference numeral 69*a* designates a side surface of the trigger associated portion 69 of the contact arm 60.

The trigger valve mechanism 50 includes a plunger 51 and the plunger spring 52. The plunger 51 is biased toward the trigger arm 42 by the plunger spring 52. The plunger 51 is movable between its top dead center and a bottom dead center. The trigger valve mechanism 50 maintains OFF state when the plunger 51 is at the bottom dead center, and becomes ON state when the plunger 51 is moved from the bottom dead center to the top dead center. This ON state can be provided by pulling the trigger 41 (pivotally moving the trigger in a counterclockwise direction in FIG. 5) in cooperation with the contact arm 60.

For nail driving operation, the distal end of the free end portion 61 of the contact arm 60 is softly placed on the groove g of the attachment member W as shown in FIG. 5. Then, the trigger 41 is pulled to pivotally move the trigger 41 toward the trigger valve mechanism 50 about the pivot shaft 43. By this pulling motion of the trigger 41, the arm pivot shaft 44 also moves toward the trigger valve mechanism 50, so that the trigger arm 42 is brought into abutment with the end of the plunger 51. As a result, the front end 42*a* of the trigger arm 42 is urged toward the distal end of the trigger associated portion 69*a*, because the end of the plunger 51 functions as a fulcrum and the arm pivot shaft 44 functions as a power point.

However, because the contact arm 60 cannot be moved any more in spite of the urging force from the front end 42*a* of the trigger arm 42, because the distal end of the free end portion 61 of the contact arm 60 has already been abutted on the groove g of the workpiece W. Because the contact arm 60 is immovable, the plunger 51 is moved to its retracted position in accordance with the pulling motion of the trigger 41. Consequently, the trigger valve mechanism 50 is turned ON to introduce compressed air onto the piston 5. Thus, the drive bit 6 moves along the nail passage 21*a* to shoot out the nail 11A from the injection passage 61*a*.

Figure 6:
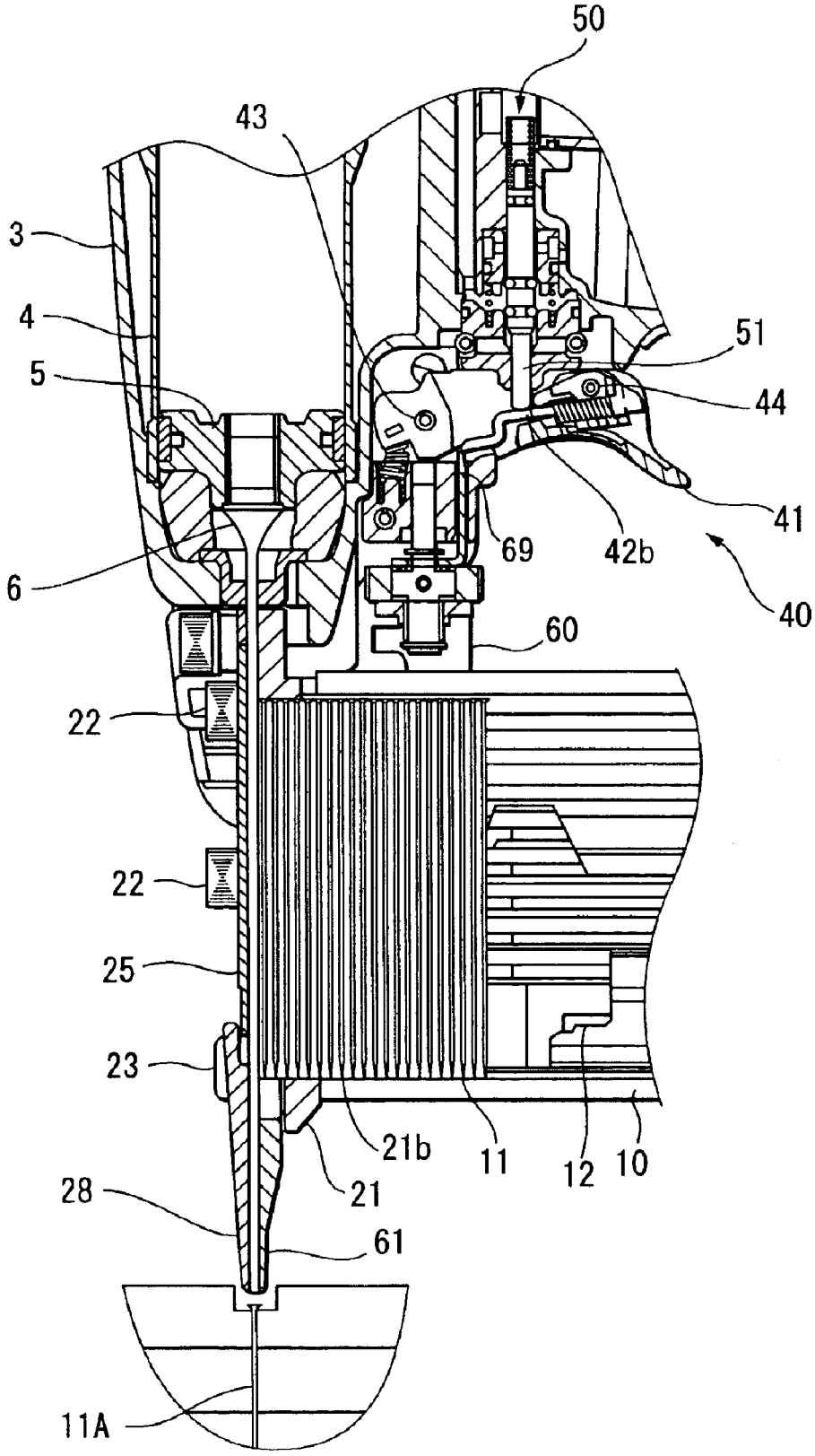
FIG. 6 is a cross-sectional side view showing a state immediately after the nail driving operation with the nail gun according to the embodiment.

As a result of nail driving into the attachment member W, the entire nail gun 1 is suddenly moved away from the attachment member W due to reaction force as shown in FIG. 6. The end of the plunger 51 urges the front end 42*a* of the trigger arm 42 downwardly in FIG. 6 by the plunger spring 52, and the biasing force of the plunger spring 52 is greater than the combined biasing force of the springs 29A, 29B (FIG. 2) which urge the contact arm upwardly in FIG. 6. Accordingly, the front end 42*a* of the trigger arm 42 pushes the upper distal end of the trigger associated portion 69 of the contact arm 60 downwardly in FIG. 6, because the end of the plunger 51 functions as a power point, and the arm pivot shaft 44 functions as a fulcrum. Consequently, the distal end of the free end portion 61 of the contact arm 60 remains in contact with the surface of the groove g of the attachment member W even though the main driving section 2 is slightly moved away from the attachment member W. In other words, the contact arm is moved toward the attachment member W relative to the main driving section 2.

Figure 7:
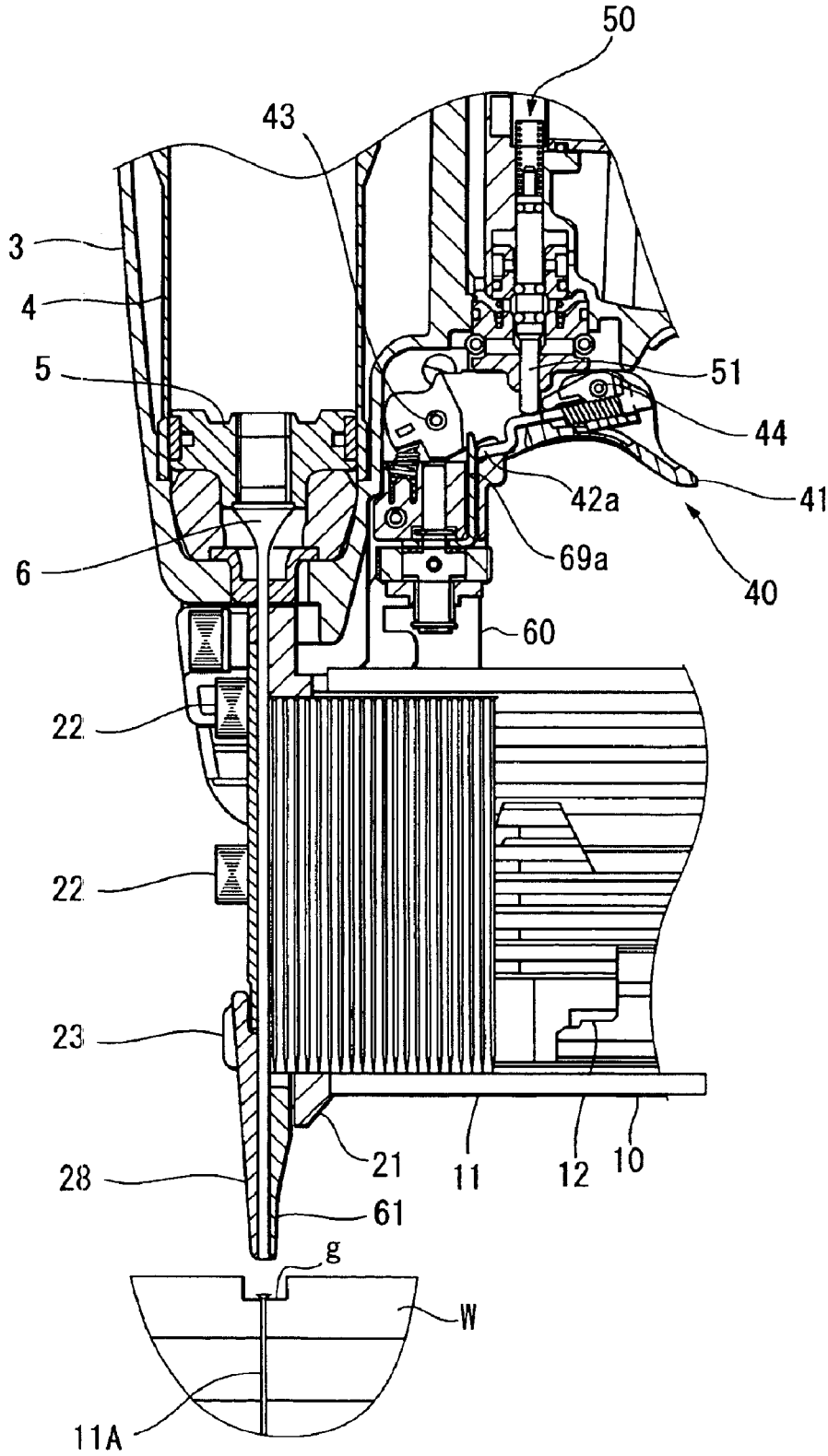
FIG. 7 is a cross-sectional side view showing a state in which the contact arm restores its top dead center position immediately after the state shown in FIG. 6.
Figure 8:
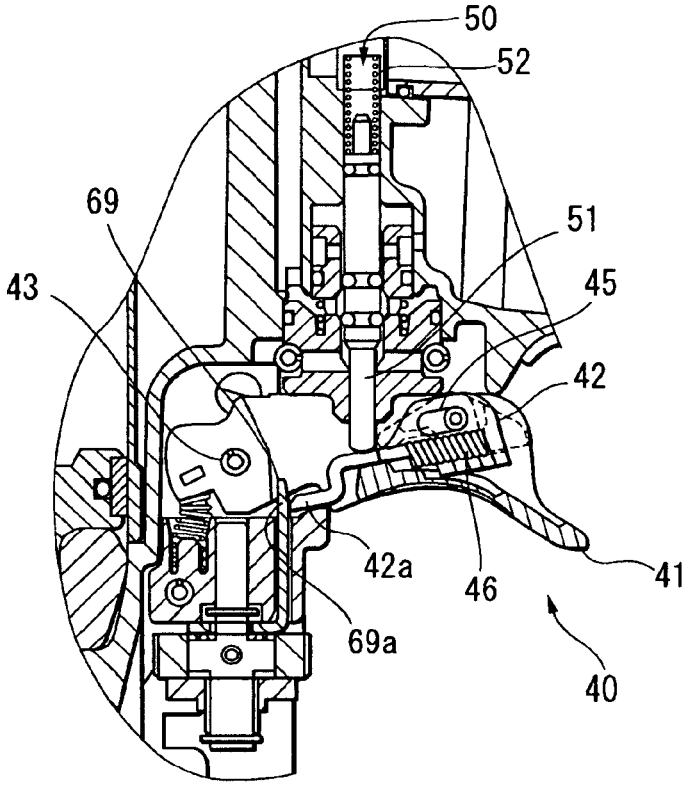
FIG. 8 is an enlarged cross-sectional view showing the trigger mechanism and the switch mechanism in the state of FIG. 7.

During the relative movement between the contact arm 60 and the main driving section 2, the front end 42*a* of the trigger arm 42 becomes disengaged from the distal end of the trigger associated portion 69 of the contact arm 60 as shown in FIGS. 7 and 8. Immediately after the disengagement, the contact arm 60 is moved to its top dead center position by the biasing force of the compression springs 29A, 29B, while the front end 42*a* of the trigger arm 42 are in sliding contact with the side surface 69*a* of the contact arm 60.

Figure 9:
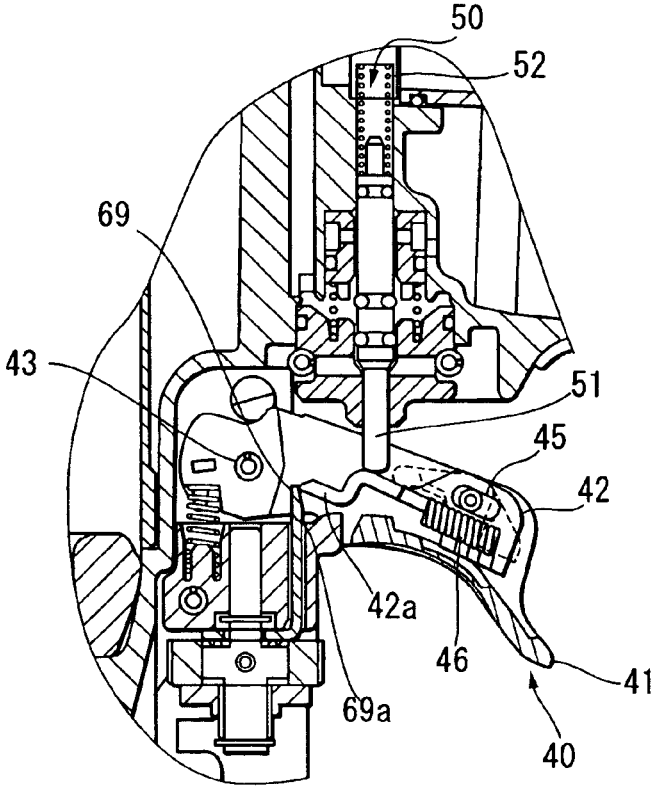
FIG. 9 is an enlarged cross-sectional view showing a releasing state of a trigger of the trigger mechanism immediately after the state of FIG. 8.
Figure 10:
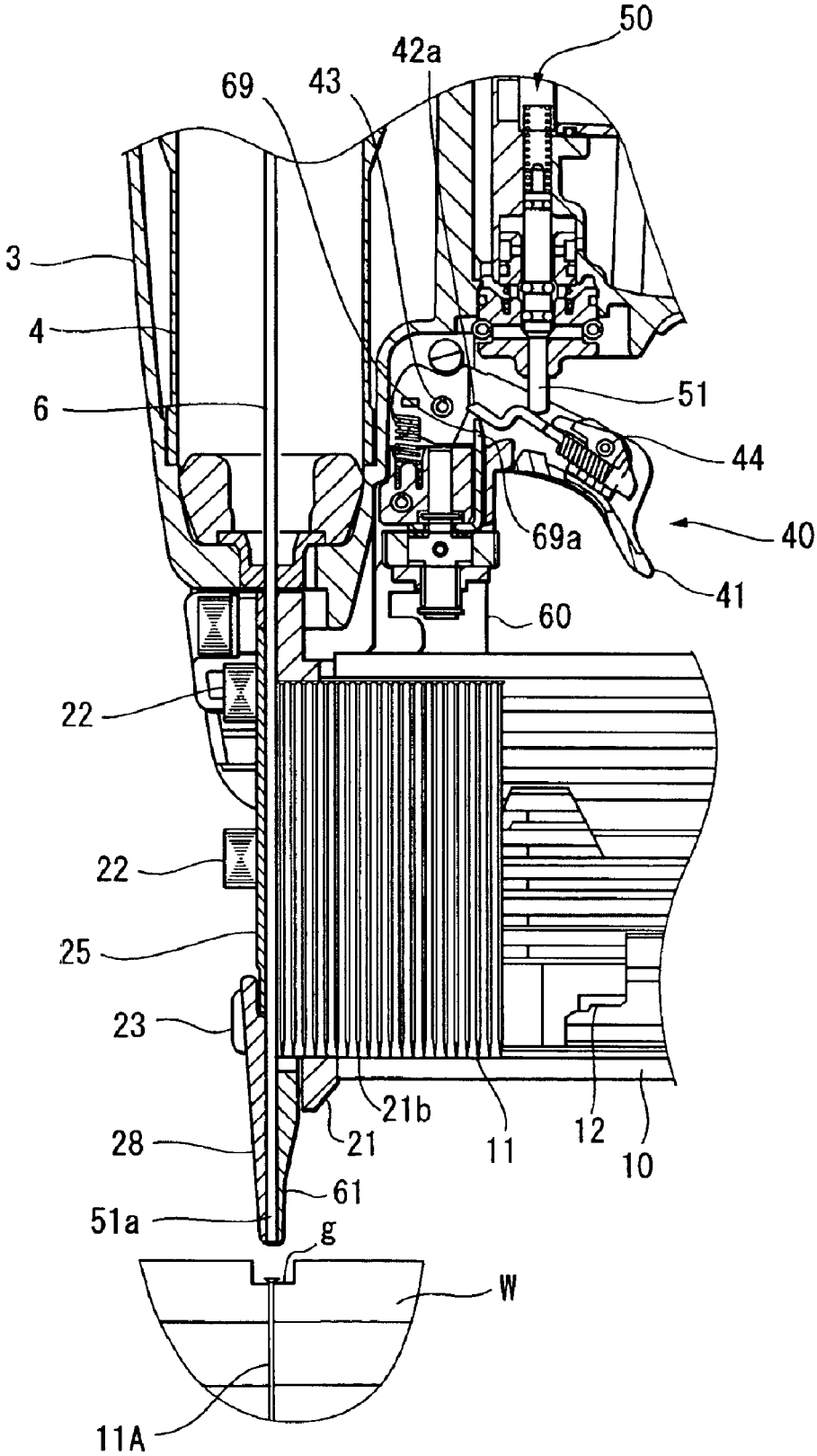
FIG. 10 is a cross-sectional side view showing a resting state of the nail gun according to the embodiment.

Then, the trigger 41 is released as shown in FIG. 9, whereupon the trigger 41 is pivotally moved about the pivot shaft 43 in a direction away from the trigger valve mechanism 50 by the urging force of the plunger spring 52 through the plunger 51 and the trigger arm 42. If an angle defined between the side surface 69*a* and the trigger arm 42 reaches a predetermined angle as a result of pivotal motion of the trigger 41, the front end 42*a* of the trigger arm 42 is brought into sliding movement along the side surface 69*a* of the contact arm 60, and the front end 42*a* again rides onto the distal end of the trigger associated portion 69 of the contact arm 60 as shown in FIG. 10 because the trigger arm 42 is always urged frontward by the spring 46.

As described above, after the nail driving operation, the front end 42*a* of the trigger arm 42 is disengaged from the distal end of the trigger associated portion 69 of the contact arm 60, so that the contact arm 60 is moved to its top dead center position by the biasing force of the compression springs 29A, 29B. Accordingly, the entire nail gun 1 does not need to be largely shifted away from the attachment member W for moving the nail gun to a next shooting position. In other words, the nail gun 1 can be moved in parallel with the surface of the attachment member W for changing the shooting position, thereby enhancing workability in the successive nail driving operation without any abutment of the tip end portion 61 of the contact arm 60 against a stepped portion such as a groove g of the attachment member W. Thus, accidental injury of the attachment member can be avoided.

If the trigger 41 is merely pulled while the tip end portion 61 of the contact arm 60 is out of contact from the attachment member W, the intermediate portion 42*b* of the trigger arm 42 is brought into contact with the free end of the plunger 51 because the arm pivot shaft 44 is moved toward the plunger 51. By the pivotal motion of the trigger 41, the front end 42*a* of the trigger arm 42 pushes the distal end of the trigger associated portion 69 of the contact arm 60 toward the bottom dead center position against the biasing force of the compression springs 29A, 29B. This is due to the fact that the biasing force of the plunger spring 52 is greater than the combined biasing force of the compression springs 29A, 29B, and that the end of the plunger 51 functions as a fulcrum, and the arm pivot shaft 44 functions as a power point. As a result, no displacement of the plunger 51 toward the plunger spring 52 occurs, to maintain OFF state. In other words, the nail driving operation cannot be started only by the pulling action of the trigger 41.

While the invention has been described in detail with reference to specific embodiments thereof, it would be apparent to those skilled in the art that various changes and modifications may be made therein without departing from the spirit and scope of the invention. For example, in the above-described embodiment, the drive bit is driven by pneumatic pressure applied to the piston 5. However, the drive bit can be electrically driven.

What is claimed is:

1. A fastener driving tool for driving a fastener into a workpiece, comprising:

a main driving section comprising a main housing, and a drive bit movable in a first direction toward the workpiece and in parallel with an extending direction of the drive bit and movable in a second direction opposite to the first direction;

a trigger mechanism pivotally movable in an operating direction and a non-operating direction and supported to the main housing;

a contact arm movable toward its top dead center position in the second direction and toward its bottom dead center position in the first direction, the contact arm having a free end portion and a trigger associating portion associatable with the trigger mechanism;

a contact arm spring for biasing the contact arm in the second direction; and, a switch mechanism comprising:

a plunger movable between OFF position where driving movement of the drive bit is prohibited and ON position where driving movement of the drive bit is permitted, the plunger being abuttable on the trigger mechanism and movable to the ON position by the movement of the trigger mechanism in the operating direction; and a plunger spring biasing the plunger toward the OFF position, the plunger spring providing a biasing force greater than that of the contact arm spring, the trigger associating portion being lockingly engaged with the trigger mechanism at least when the contact arm is positioned at its top dead center and when the trigger mechanism is moved to its operating direction, and the trigger associating portion becoming disengaged from the trigger mechanism when the contact arm moves toward the first direction thereby enabling the contact arm to be moved toward the top dead center by the biasing force of the contact arm spring.

2. The fastener driving tool as claimed in claim 1, further comprising:

an injection section disposed at one side of the main housing and extending in the first direction for allowing the drive bit to pass therethrough, a fastener being introduced to the injection section; and a magazine connected to the injection section for accommodating therein a plurality of fasteners and for feeding each fastener to the injection section.

3. The fastener driving tool as claimed in claim 2, wherein the free end portion of the contact arm is supported at the injection section, and the contact arm spring is held in the injection section.

4. The fastener driving tool as claimed in claim 3, wherein the main housing has a trigger pivot shaft, and the trigger mechanism comprises:

a trigger pivotally movably supported to the main housing by the trigger pivot shaft, the trigger having an arm pivot shaft;

a trigger arm having a front end portion positioned adjacent to the trigger pivot shaft, an intermediate portion to which the plunger is abuttable, and a base end portion formed with an elongated slot pivotally supported to the arm pivot shaft, the trigger arm being also movable in an extending direction of the elongated slot; and a trigger arm spring interposed between the trigger and the trigger arm for urging the trigger arm to the trigger pivot shaft, the trigger associated portion of the contact arm being positioned adjacent to the trigger pivot shaft, the front end portion of the trigger arm automatically lockingly engaging with the trigger associated portion as a result of movement of the trigger in the non-operating direction after the contact arm restores its top dead center position.

5. The fastener driving tool as claimed in claim 3, wherein the injection section comprises:

a bit guide extending from the main housing in the first direction and forming a faster passage along which the fastener is set and moved by the movement of the drive bit;

a guide plate in confrontation with the bit guide and fixed to the bit guide, the free end portion of the contact arm being slidably supported between the bit guide and the guide plate.

6. The fastener driving tool as claimed in claim 5, wherein the contact arm spring is interposed between the free end portion of the contact arm and the bit guide.

7. The fastener driving tool as claimed in claim 6, wherein the contact arm spring comprises a pair of compression springs positioned in symmetrical relationship with respect to the faster passage.

* * * * *